US012042710B2

(12) United States Patent
D'Alesio

(10) Patent No.: US 12,042,710 B2
(45) Date of Patent: Jul. 23, 2024

(54) DEVICE FOR PERFORMING MOTOR ACTIVITIES

(71) Applicant: REAXING S.R.L., Milan (IT)

(72) Inventor: Gionata D'Alesio, Milan (IT)

(73) Assignee: REAXING S.R.L., Milan (IT)

( * ) Notice: Subject to any disclaimer, the term of this patent is extended or adjusted under 35 U.S.C. 154(b) by 302 days.

(21) Appl. No.: 17/600,727

(22) PCT Filed: Apr. 2, 2020

(86) PCT No.: PCT/IB2020/053148

§ 371 (c)(1),
(2) Date: Oct. 1, 2021

(87) PCT Pub. No.: WO2020/202065

PCT Pub. Date: Oct. 8, 2020

(65) Prior Publication Data

US 2022/0168621 A1 Jun. 2, 2022

(30) Foreign Application Priority Data

Apr. 3, 2019 (IT) ..... 102019000005040

(51) Int. Cl.

| | |
|---|---|
| ***A63B 69/32*** | (2006.01) |
| ***A63B 24/00*** | (2006.01) |
| ***A63B 69/24*** | (2006.01) |

(52) U.S. Cl.

CPC ..... *A63B 69/322* (2022.08); *A63B 24/0021* (2013.01); *A63B 69/24* (2013.01); *A63B 69/32* (2013.01); *A63B 2024/0025* (2013.01); *A63B 2220/13* (2013.01); *A63B 2220/16* (2013.01); *A63B 2220/20* (2013.01);

(Continued)

(58) Field of Classification Search

CPC ..... A63B 69/20; A63B 69/215; A63B 69/22; A63B 69/222; A63B 69/224; A63B 69/24; A63B 69/244; A63B 69/26; A63B 69/28; A63B 69/30; A63B 69/305; A63B 69/32; A63B 69/322; A63B 69/325; A63B 24/0021; A63B 2220/13; A63B 2220/16;

(Continued)

(56) References Cited

U.S. PATENT DOCUMENTS

| | | | | |
|---|---|---|---|---|
| 9,586,120 | B1 * | 3/2017 | Sotelo | A63B 69/305 |
| 9,884,238 | B2 * | 2/2018 | Tsai | G01L 5/0052 |

(Continued)

FOREIGN PATENT DOCUMENTS

| | | |
|---|---|---|
| GB | 2 270 004 | 3/1994 |
| GB | 2 434 112 | 7/2007 |

(Continued)

OTHER PUBLICATIONS

International Search Report for PCT/IB2020/053148 dated Jul. 23, 2020, 4 pages.

(Continued)

*Primary Examiner* — Zachary T Moore
(74) *Attorney, Agent, or Firm* — NIXON & VANDERHYE

(57) ABSTRACT

Disclosed is an apparatus for performing motor activity of punch bag or similar type, the apparatus is capable of generating sensory stimuli and included a body having light sources controlled by a control unit and a sensor.

20 Claims, 5 Drawing Sheets

(52) U.S. Cl.
CPC ..... *A63B 2220/833* (2013.01); *A63B 2225/74* (2020.08); *A63B 2244/10* (2013.01); *A63B 2244/102* (2013.01)

(58) Field of Classification Search
CPC ..... A63B 2220/20; A63B 2220/833; A63B 2244/10; A63B 2244/102
See application file for complete search history.

(56) References Cited

U.S. PATENT DOCUMENTS

| | | | | |
|---|---|---|---|---|
| 2006/0252608 | A1 | 11/2006 | Kang et al. | |
| 2017/0282045 | A1* | 10/2017 | Glasner ..... | A63B 9/00 |

FOREIGN PATENT DOCUMENTS

| | | | |
|---|---|---|---|
| KR | 2016-0049111 | | 5/2016 |
| WO | 2017/175175 | A1 | 10/2017 |

OTHER PUBLICATIONS

Written Opinion of the ISA for PCT/IB2020/053148 dated Jul. 23, 2020, 5 pages.

* cited by examiner

DEVICE FOR PERFORMING MOTOR ACTIVITIES

This application is the U.S. national phase of International Application No. PCT/IB2020/053148 filed Apr. 2, 2020 which designated the U.S. and claims priority to IT Patent Application No. 102019000005040 filed Apr. 3, 2019, the entire contents of each of which are hereby incorporated by reference.

The present invention relates to an apparatus for performing motor activity and in particular an apparatus of punch bag type, that is, of the type adapted to be hit with various parts of the body of a person such as, typically, hands, legs, feet, elbows, etc., by punching, kicking, etc.

The present invention refers in general to sport education and training systems and, in particular, refers to speed, resistance, strength and coordination training and development of the body of a person.

Training systems comprising a plurality of modular devices, where each modular device comprises generation means of a sensory stimulus of illuminated type, an activation unit of the generation means and detection means of a human reaction to said stimuli, are known in the market. A training system of this kind is, for example, described in WO 2017/175175 A1.

These modular devices are generally distributed on a surface, for example placed on the ground or attached to vertical walls, to create a training system.

The alternating activation of each modular device generates light stimuli adapted to stimulate the reaction of a person who must train, who must move between one modular device and the other based on the activation sequence and interact with them as rapidly as possible, for example by touching or almost touching them with a part of the body.

Apparatus of the punch bag or boxing pad type, equipped with light sources that light up alternately to indicate a zone of the apparatus that must be hit, are also known. Apparatus of this type is marketed by Motion Fitness LLC with the trademark "3 Kick".

In this type of apparatus, the light sources consist of a plurality of annular strips, arranged at different heights around the entire circumference of the apparatus, which divide the body of the apparatus into different sectors to be hit. Therefore, a person can use the apparatus from any angle substantially by standing in front of it.

The present invention pertains to this sector and has the object of providing an apparatus for performing motor activity of punch bag type capable of implementing a sensory stimulation for the person training, which is more effective relative to prior art apparatus.

In particular, the object of the invention is to produce an apparatus capable of generating sensory stimuli that cause the person to perform complex and coordinated movements involving various parts of the body.

A further object of the present invention is to provide an apparatus that allows the simulation of typical movements of a sporting discipline such as boxing, martial arts or the like.

These and other objects are achieved with an apparatus for performing motor activity comprising an elongated body to be positioned with its axis of extension substantially vertical, the outer surface of which is adapted to be hit by at least one person with the hands, feet or other parts of the body. The body preferably has a circular section, thus having a substantially cylindrical, or polygonal, extension, preferably of a regular polygon, for example square, hexagonal, octagonal, etc.

Said outer surface of the body at least partly consists of or is covered with a soft or yielding material. According to the invention, the apparatus further comprises:

- a plurality of light sources arranged in sectors spaced angularly along the perimeter of the body, housed in respective spaces obtained in the outer surface and positioned flush or recessed relative thereto;
- first sensor means adapted to detect proximity or contact of a part of the body of the person with a zone of the apparatus;
- second sensor means adapted to detect the position of the body of the person relative to the perimeter of the body of the apparatus;
- a control unit configured to switch on or off the light sources positioned in a given angular sector of the body of the apparatus as a function of the position of the person detected by the second sensor means.

When activated, said light sources can indicate movements or actions that the person must perform (cognitive training), for example which zone of the apparatus the person must hit and with which part of the body. Lights of different colors can indicate the part of the body that must be used to hit the apparatus. To this end, preferably, said light sources emit colored light of different colors. The choice of color is managed by the control unit.

The apparatus according to the present invention is thus capable of detecting the position of the person who is training. Said position is meant as angular position relative to the outer perimeter of the apparatus or to its axis of extension. Said detection of the position, if necessary, can also comprise detection of the distance of the person from the apparatus.

The information relating to the position of the person is processed by the control unit which control switching on of some of the light sources. For example, the control unit can activate the light sources that are located in a sector of the apparatus positioned substantially in front of the person or in any case in the field of vision thereof.

To this end, according to an aspect of the invention, said second sensor means are configured to detect the presence of the person in a plurality of areas $A_1$-$A_n$ arranged substantially along a circumference around the body of the apparatus. For example, each area can define a respective circular sector on the ground.

As mentioned above, the object of the invention is to obtain equipment that causes the person also to perform other movements, in addition to those to hit the body of the apparatus.

To this end, according to an aspect of the invention, the light stimuli can also be used to convey messages to the person training different from the action of hitting the body. For example, movements to be performed can be associated with one or more colors of the light sources, for example a movement to the right or left (rotating about the apparatus) or toward or away from the apparatus.

In this way, due to the presence of the second sensor means, the control unit can verify whether the person is in the position expected and indicated, so as to activate the light sources in the field that is visible to the person. The apparatus thus configured allows stimulation of the person both to move the upper and lower limbs or other parts of the body to hit the apparatus and to perform movements around the perimeter of the apparatus. The higher the frequency with which the various light sources are switched on and off, the faster the reaction of the person must be.

Switching off a light source or a group of light sources, and subsequently switching on another light source or another group in the same angular sector, is managed by the control unit as a function of the detection of contact, or of proximity, of a part of the body with the predetermined zone of the apparatus, through the first sensor means.

According to an aspect of the invention, said light sources are arranged along vertical rows. Preferably, said rows are substantially equally spaced angularly relative to the axis of the body of the apparatus. The light sources of one row are preferably grouped in two or more groups spaced apart from one another and positioned at different levels of height. Typically, each group comprises a plurality of LEDs arranged on a rectilinear row.

The control unit, as a function of the detected position of the person, is configured to switch on a group of light sources of a row in a zone of the apparatus, or sector, facing the person.

According to another aspect of the invention, said second sensor means can be chosen from:

- pressure sensors or capacitive sensors positioned in a base arranged at the feet of the body of the apparatus;
- optical sensors or video cameras mounted on the body of the apparatus or on dedicated supports.
- accelerometers to be applied to the body of the person using the apparatus;

or equivalent devices.

Preferably, the control unit is configured to process the signals of said sensors and allocate to the person a discrete angular position relative to the axis of extension of the apparatus. For example, N areas or zones can be provided arranged around the perimeter of the apparatus, to which the position of the person is allocated and each corresponding to a sector or a zone of the surface of the apparatus.

According to a variant of the invention, the body can comprise an inner tubular element and inserts made of a soft or yielding material, attached to the outer wall of said tubular element, arranged side by side with, and spaced slightly apart from one another. The light sources are positioned in the space between adjacent inserts.

According to another aspect of the invention, the body of the apparatus can be placed on the ground or be hung from a support structure. The tubular element is equipped with movement means at least at the base or at the top, so as to be able to translate relative to the ground or to said support structure. Said movement means are, for example, wheels, if necessary mounted on guides, spherical wheels, or the like.

The apparatus can also comprise an abutment element, which can be attached to the ground or to the support structure, to limit its movement in a horizontal plane. In this way, the apparatus is able to move substantially freely in an area delimited by the abutment element. According to this variant, the apparatus is not fixed but can move after being hit by the person training.

If necessary, the apparatus can be equipped with elastic means or shock absorbers to oppose said movements in the plane of the apparatus.

According to a variant, said abutment element can be housed inside the tubular element and is adapted to coact in abutment with the inner walls thereof. The abutment element can, for example, comprise a rod or a pipe attached to the ground that is housed inside the tubular element.

According to another variant of the invention, the apparatus, at the base, is equipped with a connection joint to attach the apparatus to the ground or to a base support. Said joint is configured to allow the body to oscillate after being hit by the person. Preferably, said joint is associated with return means, adapted to maintain the body in a substantially vertical idle position, and if necessary with shock absorbers.

According to another aspect of the invention, the apparatus can comprise a motorized support, connected to the base or to the top of the body of the apparatus. Said motorized support is configured to rotate the apparatus about an axis of rotation eccentric relative to the axis of extension of the body. In this way, the apparatus can move autonomously relative to the person training. In particular, given a fixed position in which the person stands, the rotational movement of the apparatus causes it to take positions at a different distance from the person.

In this way, the person must time by time take account of the distance of the apparatus and coordinate their movements to hit the zone indicated by the light sources.

This configuration allows at least partial simulation of the fighting conditions in boxing, martial arts or similar disciplines, where the position and the distance of the opponent varies continuously.

According to an embodiment, said motorized support comprises a motor and a rotating element connected to the motor, arranged so as to rotate in a horizontal plane. The body of the apparatus is connected to the rotating element so that the axis of extension of the former is staggered relative to the axis of rotation of the latter. Advantageously, the distance between said axes can be adjustable to vary the radius of movement of the apparatus. Said rotating element can comprise, for example, a disc or rod. The body of the apparatus can, if necessary, be mounted sliding on the rotating element, along a radial direction relative to the axis of rotation.

Further features and details of the invention will be better understood from the description below, provided by way of non-limiting example, and from the accompanying drawings, wherein.

Figure 1:
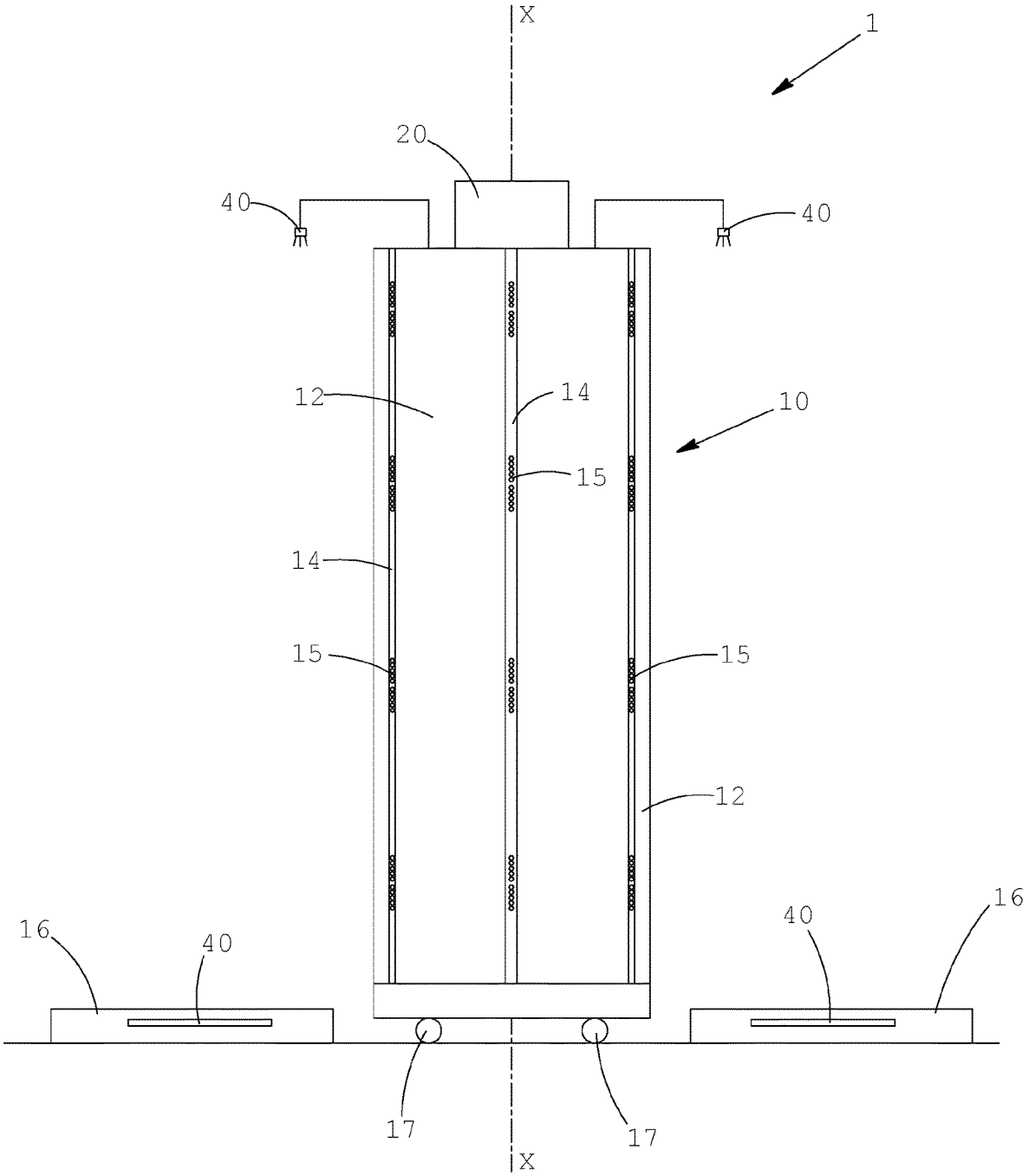
FIG. 1 is a front view of the apparatus according to the invention.

With reference to FIG. 1, the reference numeral 1 indicates as a whole the apparatus of punch bag type, which comprises a body 10 arranged with its axis of extension X substantially vertical.

The body 10 comprises a tubular element 11, the outer wall of which is fitted with inserts 12 made of a yielding material, for example expanded materials or the like, preferably covered with a flexible layer 13 made of a polymer material, fabric or other synthetic or natural materials. The tubular element 11 is preferably cylindrical in shape. The inserts 12 have an elongated rectilinear shape and, preferably, cover the entire height of the tubular element 11. The inserts 12 are arranged around the perimeter of the tubular element 11 adjacent to one other but spaced slightly apart so that there is a space 14 between each pair.

Groups of light sources 15 are arranged in each space 14, spaced apart from one another and arranged along vertical rows. Each group 15 comprises a plurality of RGB LEDs capable of emitting light of different colors.

Both the inserts 12 and the light sources 15 are preferably equally spaced angularly relative to the axis X, as in the example of the figures.

The outer surfaces of the inserts 12, as a whole, give the body of the apparatus a substantially cylindrical shape.

The light sources 15 are supplied and controlled by a control unit 20 mounted on the apparatus, for example on the inside of the tubular element 11, at the top, as shown in the example of the figures, or on the outside.

Figure 2:
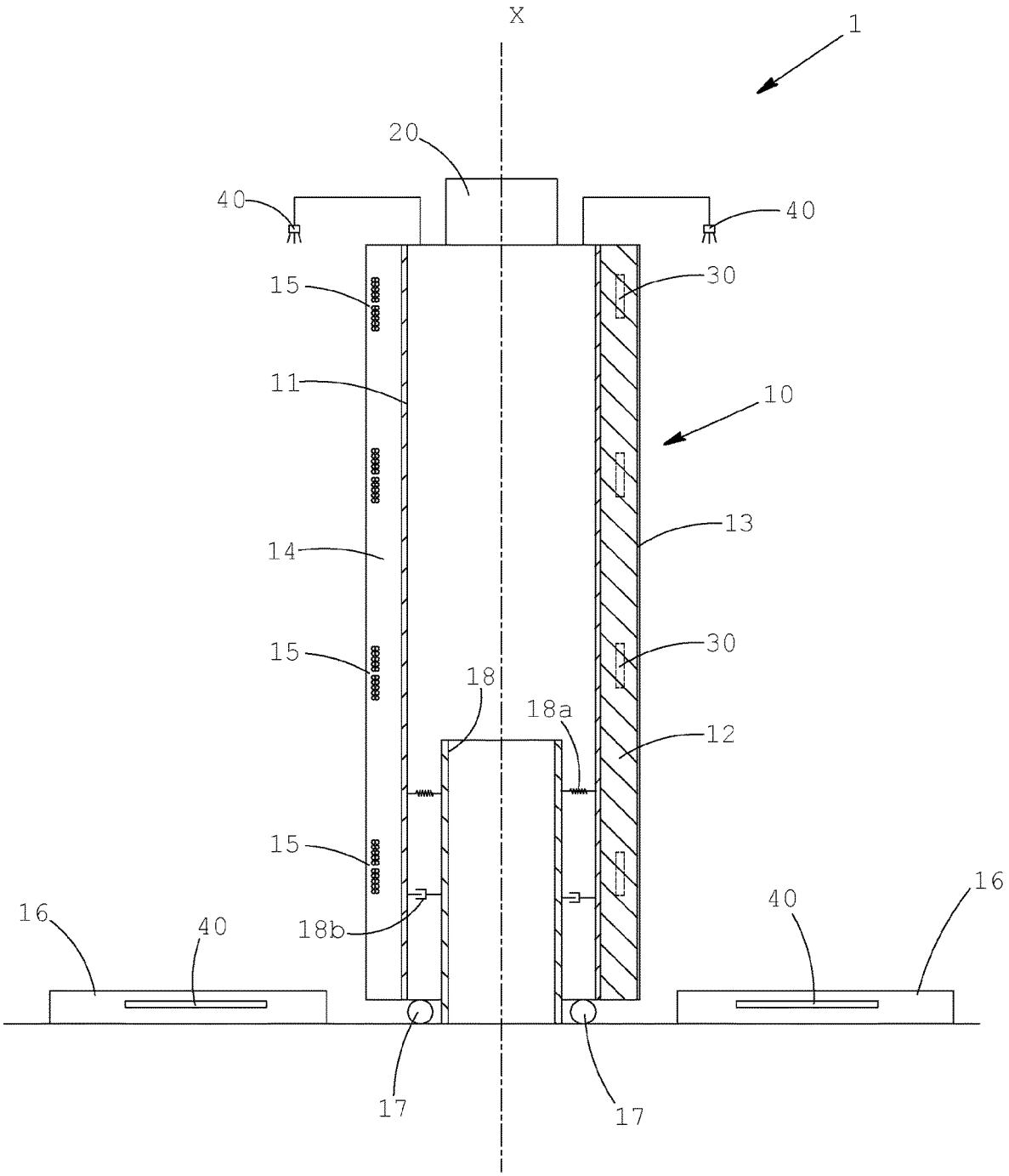
FIG. 2 is a sectional view of the apparatus of FIG. 1.
Figure 3:
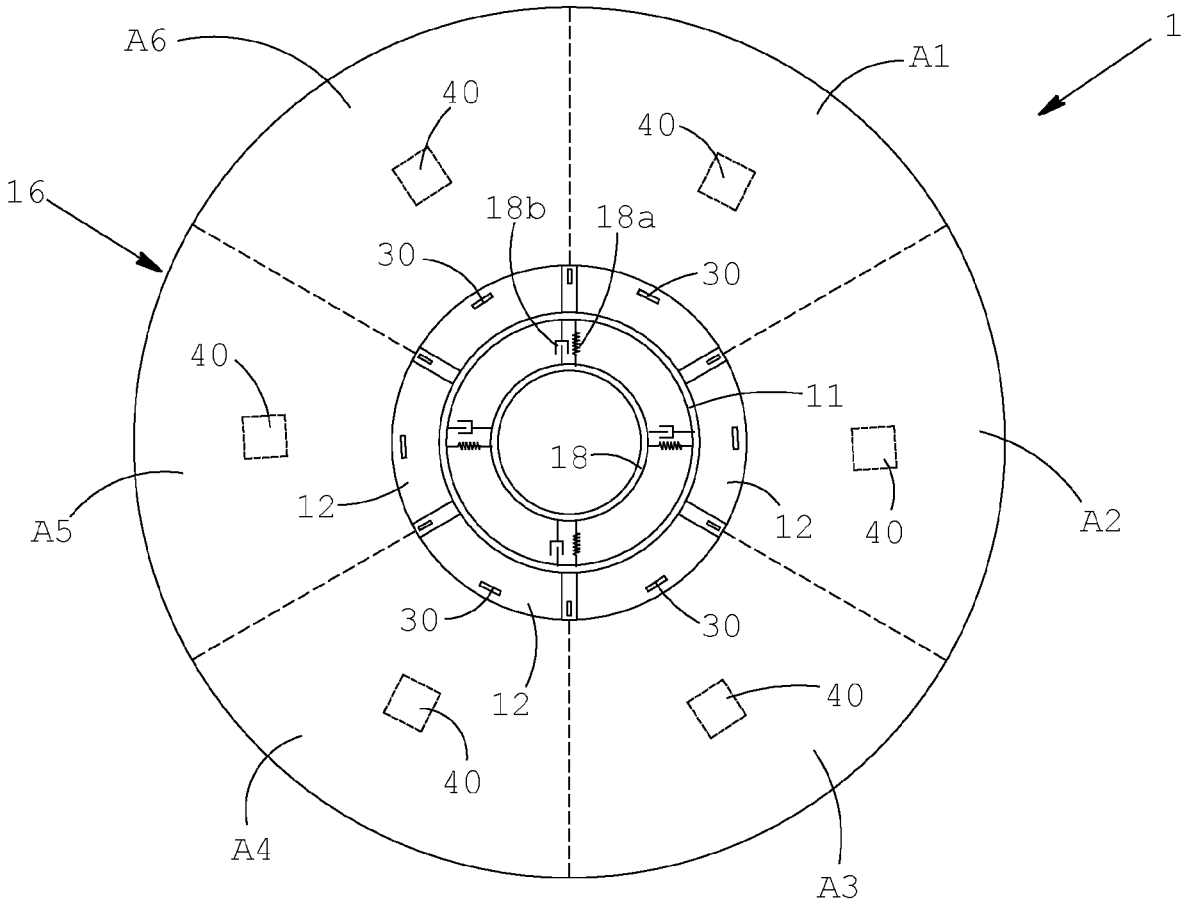
FIG. 3 is a plan view of the apparatus of FIG. 1.

The apparatus further comprises first sensor means 30, represented schematically in FIGS. 2 and 3, adapted to detect contact of the part of the body of the person with the surfaces of the apparatus or even only proximity at a predetermined distance. Said first sensor means 30 can, for example, comprise accelerometers, optical or ultrasonic proximity sensors or other sensors with the same function. Said first sensor means 30 are typically installed in the body of the apparatus, for example under the surface of the inserts 12 or in the vertical spaces 14.

The apparatus further comprises second sensor means 40 to detect the position of the body of the person relative to the apparatus 1 and, in particular, the angular position of the person relative to the axis of extension X of the body 10.

According to an embodiment, said second sensor means 40 comprise pressure sensors positioned in a base 16 arranged around the apparatus. Alternatively, other types of sensors, such as capacitive or equivalent, can be provided in the base 16.

According to this embodiment, the pressure sensors are arranged equally spaced angularly relative to the axis of extension X of the body 10, preferably in the same number as the number of sectors of the light sources.

Alternatively, or additionally, said second sensor means 40 can comprise optical sensors, video cameras or the like. These can be installed on the apparatus, for example at the top as in the example of the figures, or on external supports.

The second sensor means are connected to the control unit 20 which processes the signals to determine a discrete position of the person, for example associated with one of the areas $A_1, A_2, \ldots, A_n$ defined around the apparatus. Each area is associated by the control unit with a corresponding sector of the body and more precisely with related groups of light sources 15.

According to a variant of the invention, the body 10 of the apparatus 1 is provided, at its base, with movement means 17, preferably of rolling type. Said rolling means 17 allow the apparatus to move in a horizontal plane following the actions performed by the person training.

To limit these movements, an abutment element 18 is provided, in the form of tube or bar, attached to the ground and which extends inside the tubular element 11. The movement of the apparatus 1 is determined by the inner dimension of the tubular element 11 and by the outer dimension of the abutment element 18.

Preferably, elastic means 18*a* and/or shock absorbers 18*b* are provided, which act between the abutment element 18 and the tubular element 11, to oppose the movements of the apparatus.

Figure 4:
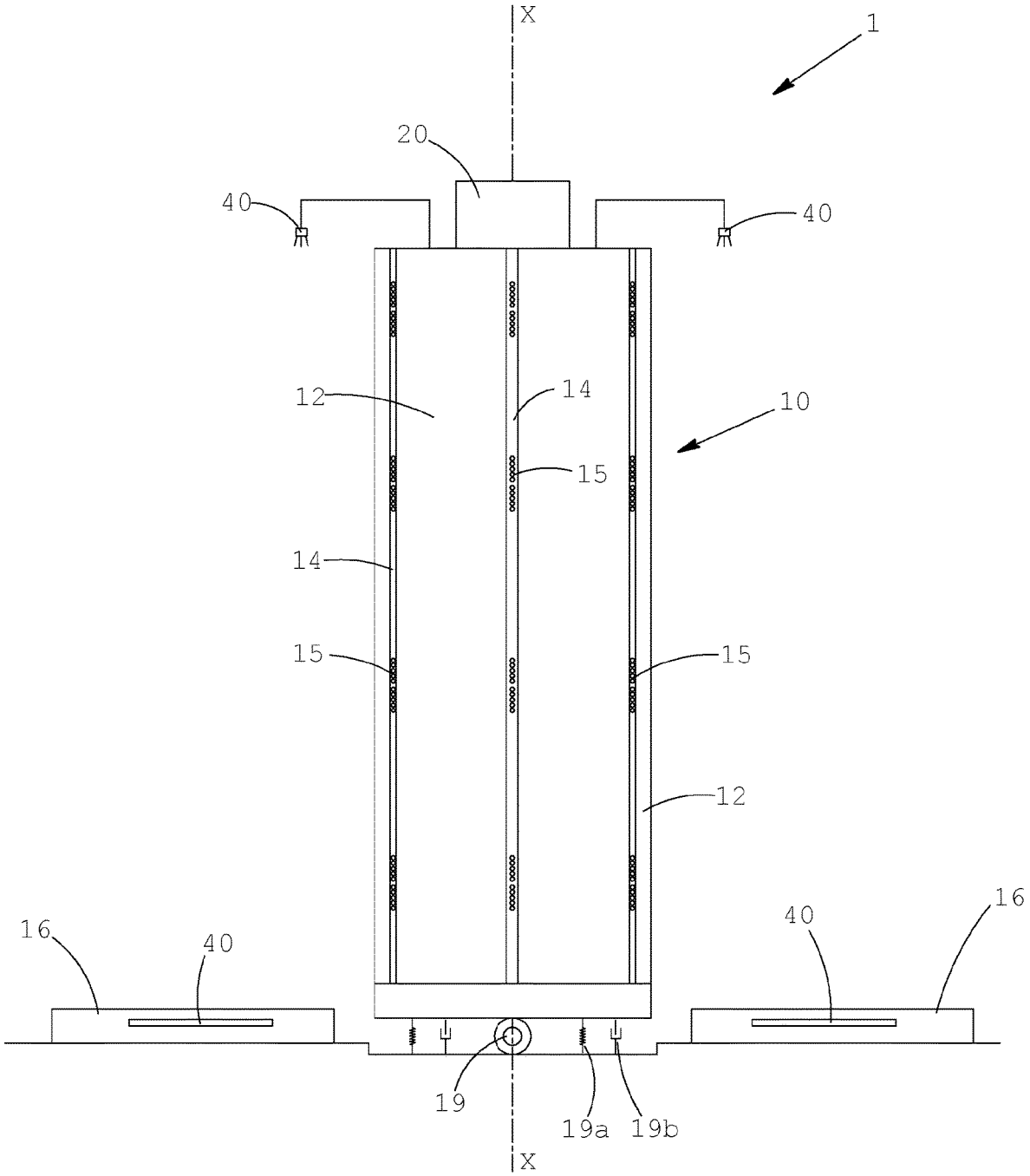
FIG. 4 is a front view of the apparatus according to another embodiment of the invention.

According to an alternative variant, illustrated in FIG. 4, the body 10 of the apparatus is connected to the ground or to a base support by means of a joint 19, for example a hinge or ball joint. The joint 19 allows the body 10 to oscillate slightly when it is hit by the person. Preferably, the joint 19 is associated with return means 19*a* adapted to maintain and/or to return the body of the apparatus substantially vertical in an idle condition, and if necessary with shock absorbers 19*b* to limit the speed and/or amplitude of the oscillations.

Figure 5:
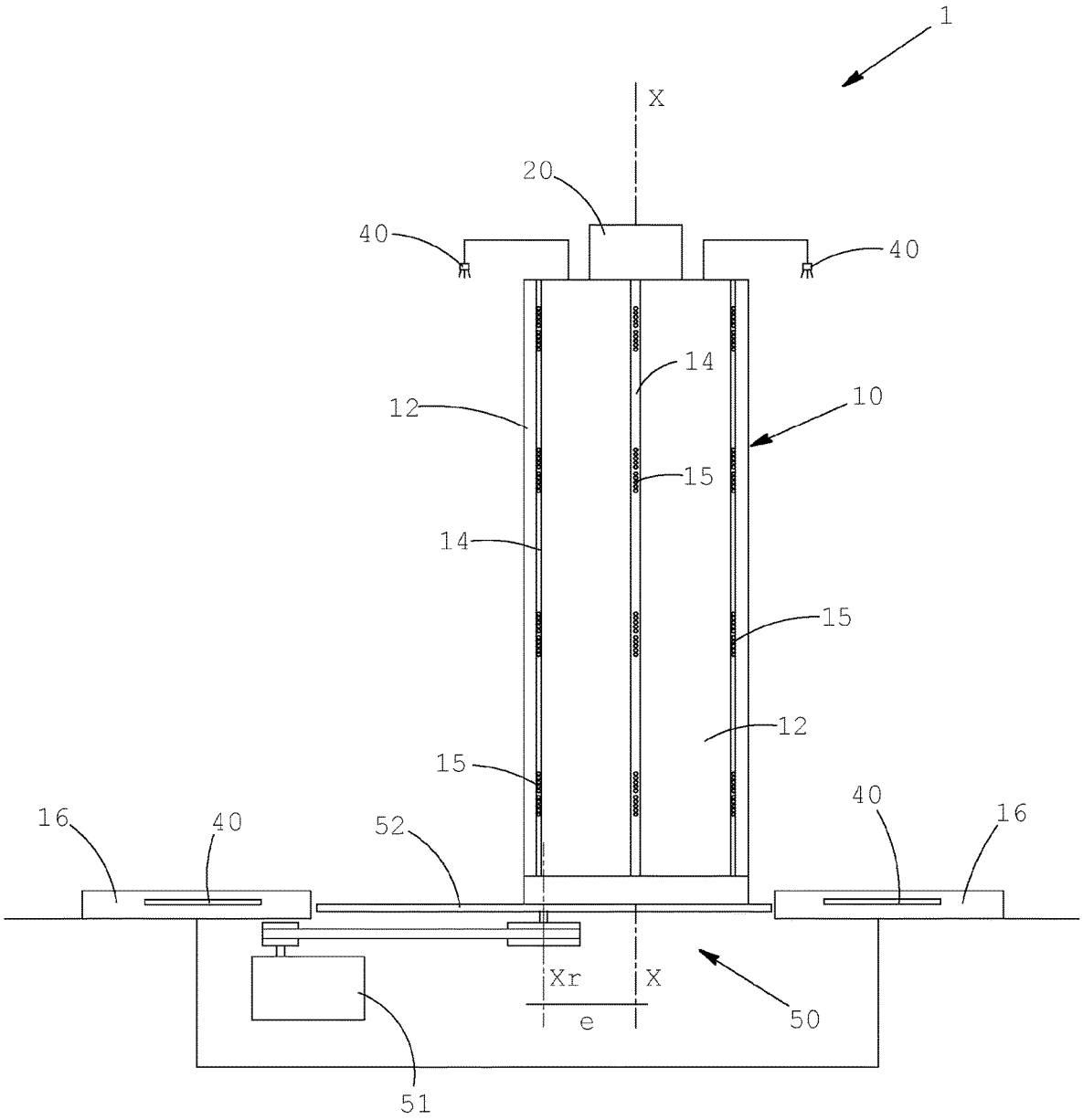
FIG. 5 is a front view of the apparatus according to another embodiment of the invention.

According to another variant, illustrated in FIG. 5, the apparatus 1 comprises a motorized support 50 placed connected to the body 10 at its base. Said motorized support 50 comprises a motor 51 that drives a disc shaped rotating element 52, which rotates about an axis of rotation Xr. The body 10 of the apparatus 1 is connected to the rotating element 52 so that the axis of extension X of the body is eccentric by a value and relative to the axis of rotation Xr of the rotating support.

Preferably, the body 10 of the apparatus is mounted on the disc 52 so that it can slide along a radial direction relative to the axis of rotation Xr or can be connected to said disc 52 in several points at different distances from said axis rotation Xr.

The invention has been described purely for non-limiting illustrative purposes, according to some preferred embodiments. Those skilled in the art can find many other embodiments and variants, all falling within the scope of protection of the appended claims.

The invention claimed is:

1. An apparatus for performing motor activity comprising an elongated body with a substantially circular or polygonal section to be positioned with a main axis of extension substantially vertical, an outer surface of which is adapted to be hit by at least one person with hands, feet or other parts of the person, said outer surface at least partly comprised of or covered with a soft or yielding material, the apparatus further comprising:

a plurality of light sources arranged in angular sectors spaced angularly along a perimeter of the body, housed in respective spaces formed in the outer surface and positioned flush or recessed relative thereto;

first sensor means adapted to detect proximity or contact of the hands, the feet, or the other parts of the person with the apparatus;

second sensor means adapted to detect a position of the person relative to the perimeter of the body of the apparatus; and a control unit configured to switch on or off the light sources positioned in a respective angular sector of the angular sectors of the body of the apparatus as a function of the position of the person detected by the second sensor means.

2. The apparatus according to claim 1, wherein said second sensor means are adapted to detect the position, the positioning being an angular position of the person relative to the main axis of the body of the apparatus.

3. The apparatus according to claim 2, wherein said second sensor means are configured to detect the position, the position further being a presence of the person in a plurality of areas $A_1$-$A_n$ arranged substantially along a circumference around the body of the apparatus.

4. The apparatus according to claim 3, wherein said second sensor means are adapted to detect a distance of the person from the body of the apparatus.

5. The apparatus according to claim 3, wherein said light sources are arranged along vertical rows equally spaced angularly relative to the main axis of extension of the body of the apparatus.

6. The apparatus according to claim 3, wherein the light sources are configured to emit colored light with different colors, a choice of color during activation of a respective light source being managed by the control unit.

7. The apparatus according to claim 2, wherein said second sensor means are adapted to detect a distance of the person from the body of the apparatus.

8. The apparatus according to claim 2, wherein said light sources are arranged along vertical rows equally spaced angularly relative to the main axis of extension of the body of the apparatus.

9. The apparatus according to claim 2, wherein the light sources are configured to emit colored light with different colors, a choice of color during activation of a respective light source being managed by the control unit.

10. The apparatus according to claim 1, wherein said second sensor means are adapted to detect the position, the position being a distance of the person from the body of the apparatus.

11. The apparatus according to claim 10, wherein said light sources are arranged along vertical rows equally spaced angularly relative to the main axis of extension of the body of the apparatus.

12. The apparatus according to claim 1, wherein said light sources are arranged along vertical rows equally spaced angularly relative to the main axis of extension of the body of the apparatus.

13. The apparatus according to claim 12, wherein the light sources of one row of the vertical rows are grouped into two or more groups positioned at different heights.

14. The apparatus according to claim 1, wherein the light sources are configured to emit colored light with different colors, a choice of color during activation of a respective light source being managed by the control unit.

15. The apparatus according to claim 1, wherein said second sensor means are chosen from:

pressure sensors or capacitive sensors positioned in a base arranged at feet of the body of the apparatus;

optical sensors or video cameras mounted on the body of the apparatus or on dedicated supports; and accelerometers configured to be applied to the person who uses the apparatus.

16. The apparatus according to claim 1, wherein the body comprises a tubular element and inserts made of the soft or yielding material, applied side by side along the perimeter of the body, the light sources being positioned in the space between two adjacent inserts.

17. The apparatus according to claim 16, wherein the body of the apparatus is placed on a ground or is hung on a support structure, the tubular element being equipped with movement means at least at a base or at a top so as to be able to translate relative to the ground or to said support structure, the apparatus further comprising an abutment element, attachable to the ground or to the support structure, to limit movement of the apparatus in a horizontal plane.

18. The apparatus according to claim 17, wherein said abutment element is housed inside the tubular element and is adapted to coact in abutment with inner walls thereof.

19. The apparatus according to claim 1, further comprising a motorized support connected to a base or to a top of the body of the apparatus, said motorized support being configured to rotate the apparatus about an axis of rotation eccentric relative to the axis of extension of the body, a distance between said axes being adjustable.

20. The apparatus according to claim 19, wherein said motorized support comprises a motor and a rotating element connected to said motor and arranged so as to rotate in a horizontal plane, and wherein the body of the apparatus is mounted sliding on said rotating element.

* * * * *